United States Patent [19]

Matsumoto et al.

[11] 4,064,844

[45] Dec. 27, 1977

[54] APPARATUS AND METHOD FOR SUCCESSIVELY INACTIVATING THE CYLINDERS OF AN ELECTRONICALLY FUEL-INJECTED INTERNAL COMBUSTION ENGINE IN RESPONSE TO SENSED ENGINE LOAD

[75] Inventors: Junichiro Matsumoto; Haruhiko Iizuka, both of Yokosuka; Fumiaki Kato, Yokohama, all of Japan

[73] Assignee: Nissan Motor Co., Ltd., Yokohama, Japan

[21] Appl. No.: 724,082

[22] Filed: Sept. 16, 1976

[30] Foreign Application Priority Data

Sept. 17, 1975 Japan ..... 50-111703

[51] Int. Cl.[2] ..... F02B 3/00

[52] U.S. Cl. ..... 123/32 EA; 123/32 EH; 123/32 EL; 123/198 F

[58] Field of Search ..... 123/32 EA, 32 EH, 32 EL, 123/139 DE, 198 F

[56] References Cited

U.S. PATENT DOCUMENTS

| | | | |
|---|---|---|---|
| 2,166,968 | 7/1939 | Rohlin | 123/198 F |
| 2,394,738 | 2/1946 | Anthony | 123/198 F |
| 2,745,391 | 5/1956 | Winkler | 123/198 F |
| 2,757,651 | 8/1956 | Winkler | 123/198 F |
| 2,875,742 | 3/1959 | Dolza | 123/198 F |
| 2,878,798 | 3/1959 | Dolza et al. | 123/198 F |
| 2,918,047 | 12/1959 | Mick | 123/198 F |
| 3,181,520 | 5/1965 | Mock | 123/198 F |
| 3,756,205 | 9/1973 | Frost | 123/32 EA |
| 3,866,584 | 2/1975 | Bigalke et al. | 123/32 EL |
| 4,007,590 | 2/1977 | Nagai et al. | 123/32 EA |

*Primary Examiner*—Charles J. Myhre
*Assistant Examiner*—Andrew M. Dolinar

[57] ABSTRACT

In a multi-cylinder fuel injection type internal combustion engine, apparatus is provided for successively inactivating one or more cylinders of the engine by inhibiting the injection pulses supplied to the fuel injection units in response to a sensed engine load. The apparatus includes a forward-backward counter which operates in downward count mode to decrease the number of active cylinders when light load is sensed and in forward count mode to increase the number of active cylinders when heavy load is sensed. A ring counter is provided to generate recylically occurring pulses on its output terminals equal in number to said cylinders successively in response to the occurrence of each injection pulse. A logic circuit is connected to the ring counter to generate injection inhibit pulses equal in number to the inactive cylinders.

11 Claims, 4 Drawing Figures

Figures 1A, 1B:
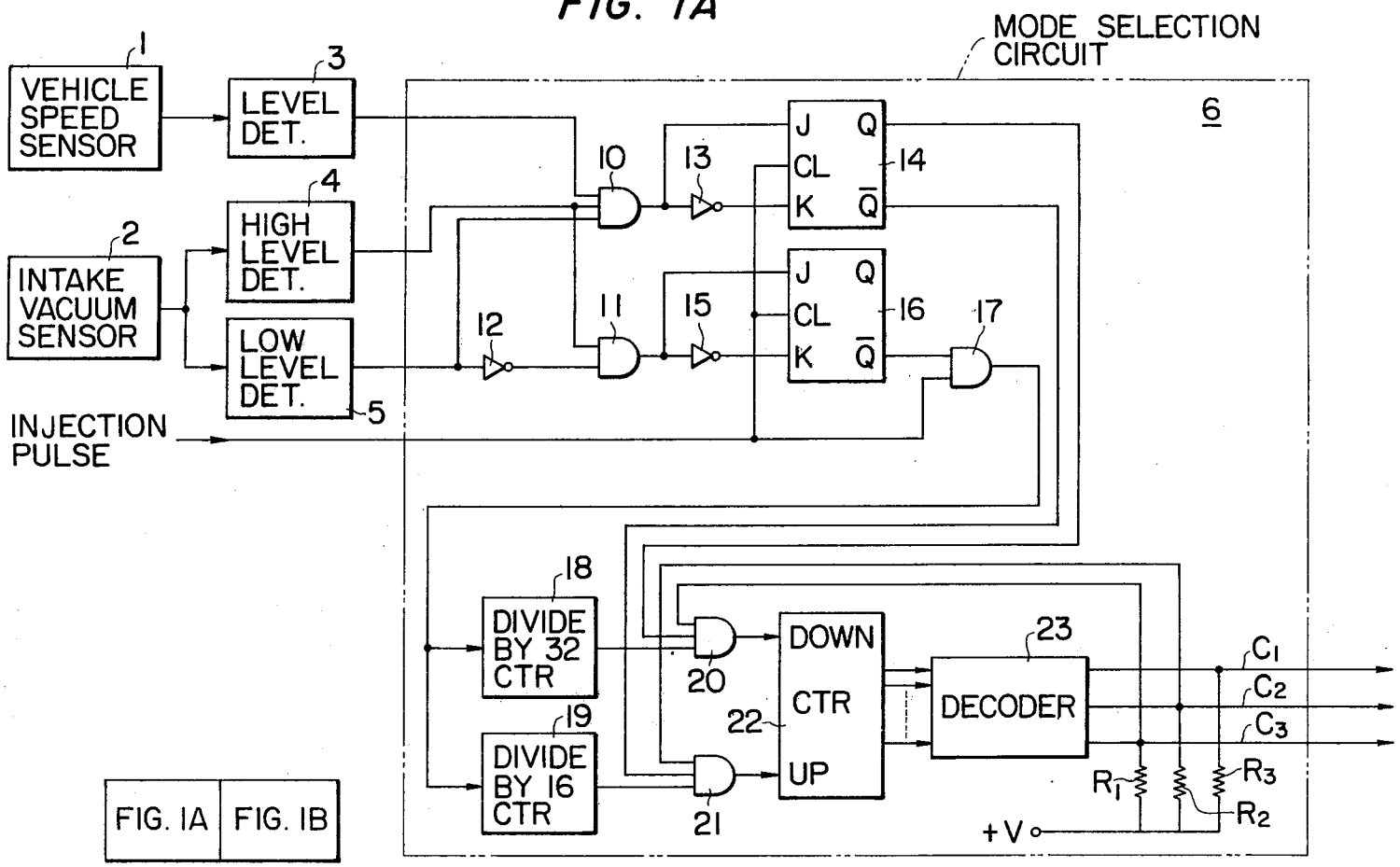
Figure 1B:
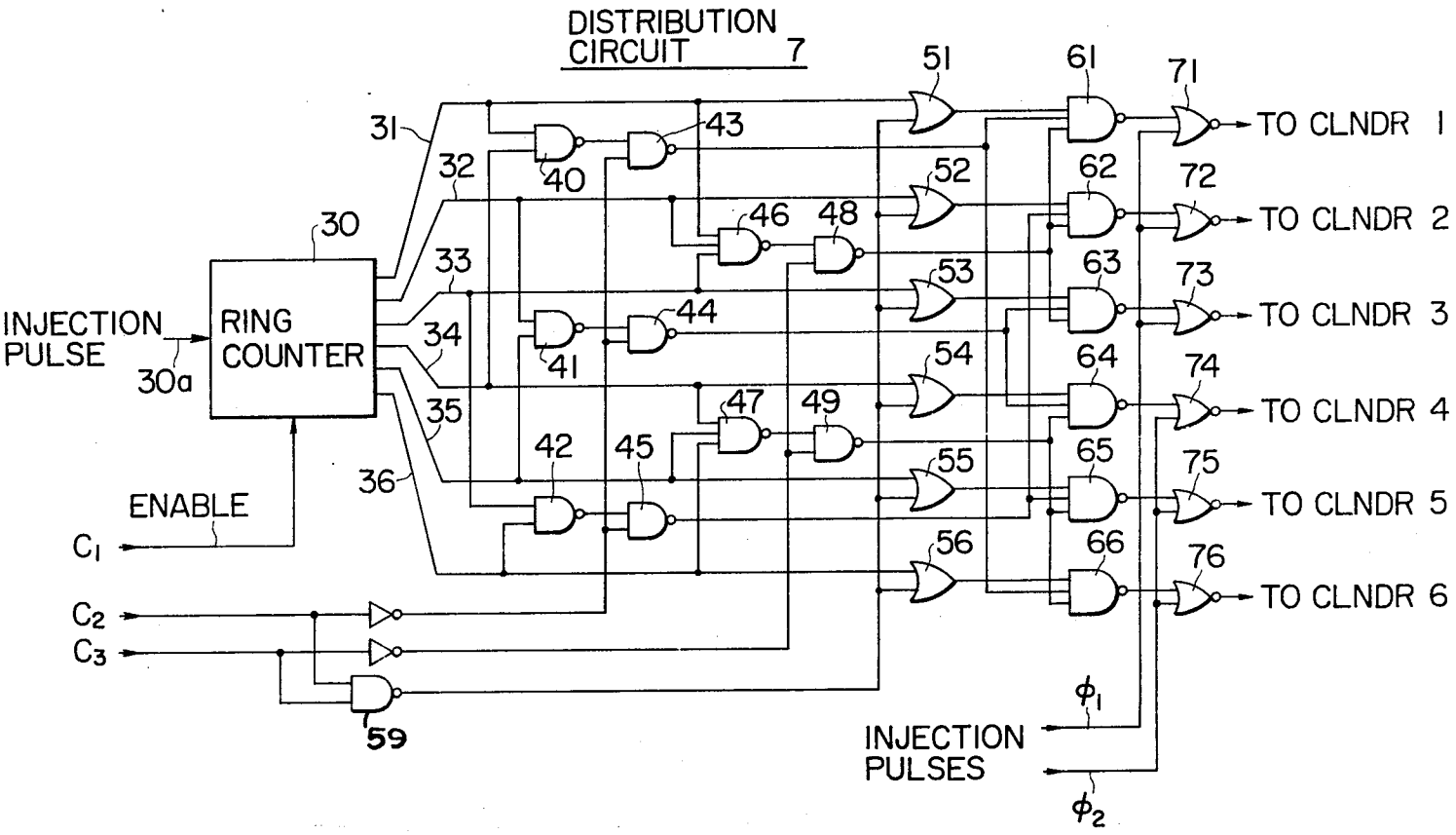

MODE SELECTION CIRCUIT
6
VEHICLE SPEED SENSOR
1
INTAKE VACUUM SENSOR
2
INJECTION PULSE
LEVEL DET.
3
HIGH LEVEL DET.
4
LOW LEVEL DET.
5
J
CL
K
Q
Q̄
14
16
10
11
12
13
15
17
DIVIDE BY 32 CTR
18
DIVIDE BY 16 CTR
19
20
21
DOWN
CTR
UP
22
DECODER
23
C1
C2
C3
R1
R2
R3
+V

APPARATUS AND METHOD FOR SUCCESSIVELY INACTIVATING THE CYLINDERS OF AN ELECTRONICALLY FUEL-INJECTED INTERNAL COMBUSTION ENGINE IN RESPONSE TO SENSED ENGINE LOAD

The present invention relates generally to electronic fuel injection and in particular to apparatus and method for controlling the injection of fuel of the cylinders of an internal combustion engine by successively inactivating the cylinders in response to sensed engine load.

Electronic fuel injection is extensively used on account of its ability to provide accurate proportioning of air-fuel mixture for each cylinder in response to engine operating parameters. In prior art fuel injection systems, all of the cylinders are fuel injected for ignition regardless of the magnitude of the engine load. However, the specific fuel consumption (g/PS.h) for light load operation is unsatisfactory from the standpoint of fuel economy.

The primary object of the present invention is to provide injection control apparatus and method for internal combustion engines in which the fuel supply for portions of the cylinders is cut off in response to the engine load, whereby the active or ignited cylinders may be supplied with a larger amount of fuel to maintain the speed level under the same engine load so that the specific fuel consumption is improved.

Another object of the invention is to cut off portions of cylinders such that the active cylinders are successively decreased one cylinder at a time when light load condition is encountered and are successively increased one cylinder at a time when heavy load condition is encountered.

A further object of the invention is to provide apparatus and method for controlling the injection of fuel in which the number of ignited cylinders successively increases at a higher rate when the heavy load condition is encountered than the rate at which the active cylinders decrease successively when the light load condition is encountered.

A still further object of the invention is to provide apparatus for the control of injection fuel in which the number of active cylinders remains constant when medium engine load is encountered.

Briefly described, apparatus embodying the present invention comprises a sensor for detecting the magnitude of the engine load, a first electronic control circuit that varies the number of cylinders to be fuel injected for ignition in response to the sensed magnitude of the engine load such that the ignited cylinders decrease in number successively one at a time when light load condition is encountered and increase in number successively one at a time when heavy load condition is encountered, and a second electronic circuit that generates enable and disable control pulses for the cylinders corresponding to the number of inactive cylinders and distributes the disable control pulse or pulses to the fuel injection units of the cylinders in succession in response to the combustion cycle of each cylinder.

When the engine is operated with a smaller number of active cylinders under light load condition, the vehicle driver will accelerate the engine by opening the throttle valve by an amount that compensates for the loss of engine output power available due to the partial fuel cut-off, so that the active cylinders will be supplied with an additional amount of fuel so as to achieve best fuel economy under the light load condition.

Since the number of active cylinders is designed to vary in succession on a one-cylinder-at-a time basis, the vehicle driver will have no feeling that the engine output power has suddenly changed during transitional periods of engine load.

Figure 2A:
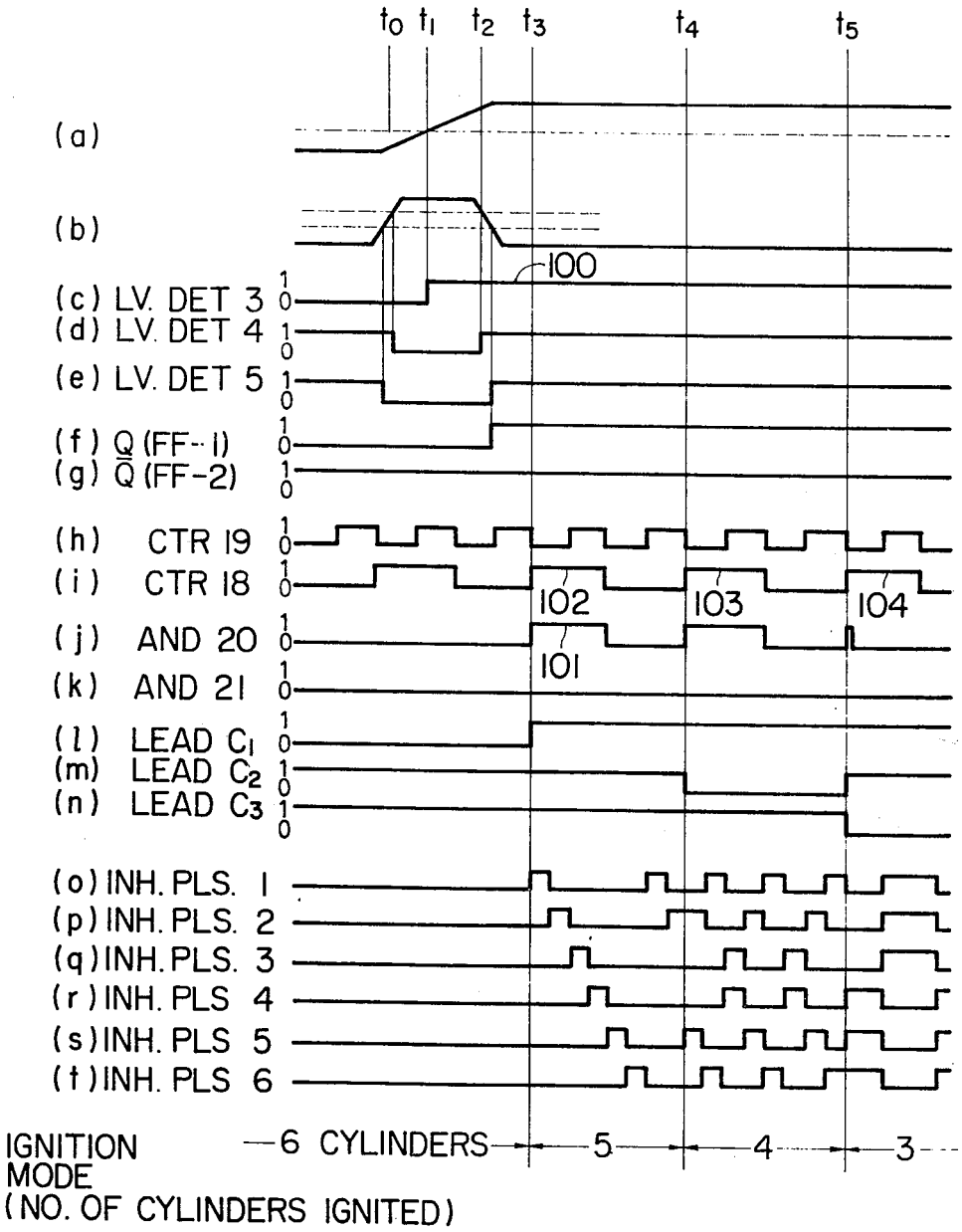
Figure 2B:
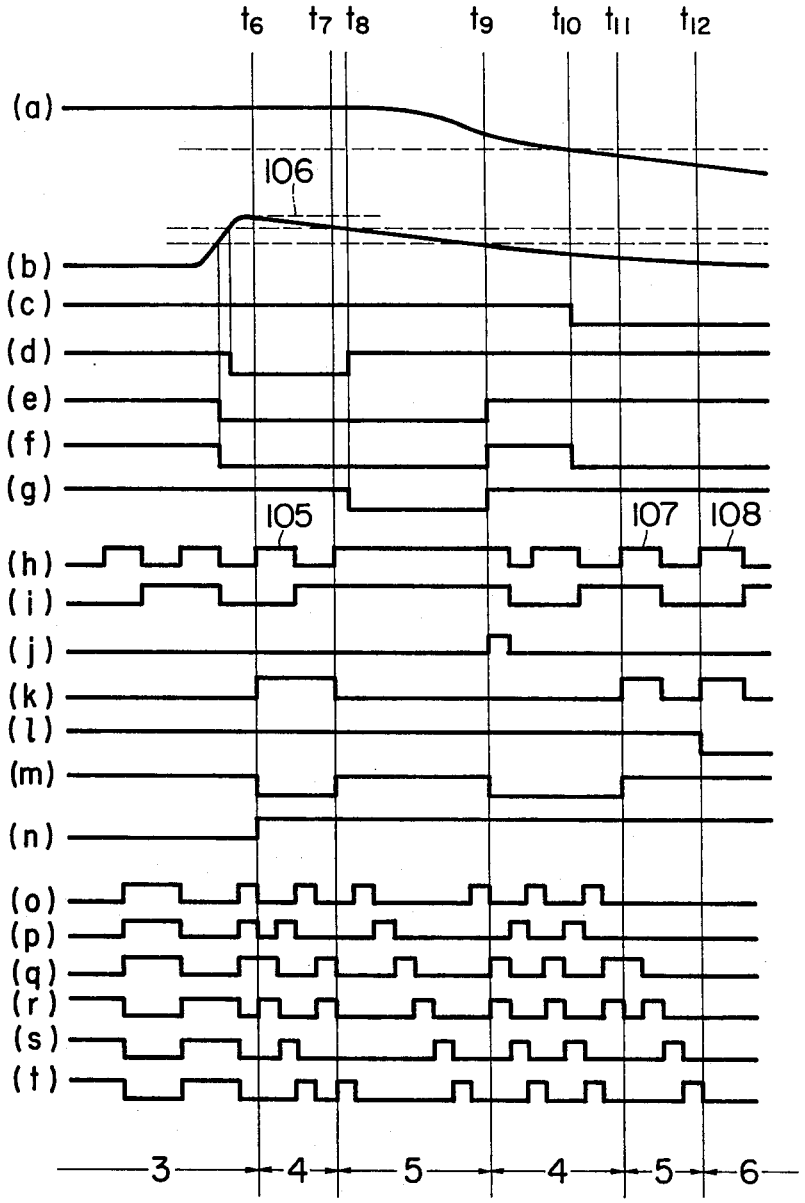

The invention will be further described in detail in connection with the accompanying drawings, in which:

FIGS. 1A and 1B show an embodiment of the present invention in circuit block diagram; and FIGS. 2A and 2B are timing diagrams illustrating various waveforms appearing in the circuit diagram of FIGS. 1A and 1B.

Referring now to FIGS. 1A and 1B, the embodiment of the present invention is shown as comprising generally a vehicle speed sensor 1, an intake vacuum sensor 2, level detectors 3, 4 and 5, a mode selection circuit 6 that determines the number of cylinders to be ignited, and an injection pulse distribution circuit 7. The vehicle speed sensor 1 may conveniently detect the revolution of the wheels to generate a voltage signal of which the magnitude is representative of the vehicle speed. The level detector 3 provides a high-level output when the vehicle speed is above a predetermined value by comparing the input speed representative signal with a reference voltage which is selected so that the output is provided when the vehicle speed is above 30 km/h, for example. The intake vacuum sensor 2 detects the depression in pressure in the intake manifold of the engine and generates a voltage signal representative of the magnitude of the pressure depression and applies it to the high and low level detectors 4 and 5. The high level detector provides a low level or "O" output when the depression is greater than a first predetermined value and the low level detector provides a "O" output when the depression is greater than a second predetermined value smaller than the first predetermined value.

The output signals from the level detectors 3 to 5 are fed into an AND gate 10 and the output signal from the high level detector 4 is fed into an AND gate 11 to which is also applied the output from the low level detector 5 through an inverter 12. The AND gate 10 thus provides a high level output when the vehicle speed is above 30 km/h and the pressure depression is below the second or lower predetermined level, while the AND gate 11 provides high level output when the vacuum pressure lies between the first and second predetermined levels.

When the throttle valve is shifted from the closed to open positions to start the vehicle, pressure depression occurs in the intake manifold behind the throttle valve. It is assumed that in FIG. 2A the vehicle speed reaches 30 km/h level at time $t=t_1$, the level detector 3 generates an output signal 100. The heavy load condition exists until the vehicle reaches a constant speed level which is higher than the 30 km/h level. It is assumed that at time $t=t_2$ the constant or cruising speed level is reached, the throttle valve is adjusted for part throttle operation with the consequent decrease in the pressure depression in the intake manifold, as a result of which the AND gate 10 generates a "1" output. The "1" output from AND gate 10 is applied to the J input terminal of, and through an inverter 13 to the K input terminal of, a J-K flip-flop 14 and the Q output of which goes high. Also provided is a J-K flip-flop 16 having its J input terminal connected to the output of AND gate 11 and its K input terminal connected through an inverter 15 to the output of AND gate 11. The clock input terminal of both flip-flops 14 and 16 is connected to a source of injection pulses. The injection pulses are applied through an AND gate 17 to a divide-by 32 counter 18 and a divide-by 16 counter 19. The AND gate 17 is enabled by the Q output of flip-flop 16 which is usually in the high output state and goes low only when injection pulse occurs while the AND gate 11 is in the high output state. Since the AND gate 11 is in the high output state when the pressure depression in the intake manifold is between the high and low depression levels, the Q output of flip-flop 11 will remain high if it is assumed that the rate of pressure change is sufficiently high at times $t=t_0$ and $t=t_2$ so that the duration of the high output from AND gate 11 is smaller than the interval between successive injection pulses. Through the enabled AND gate 17, the counters 18 and 19 are both driven by the injection pulses. The counter 18 provides an output for every count of 32 input injection pulses and applies it through an AND gate 20 to a down count input of a forward-backward counter 22. The counter 19, on the other hand, provides an output for every count of 16 input injection pulses and feeds it through an AND gate 21 to the up count input of the forward-backward counter 22. For the sake of simplicity, the description will proceed with the divide-by 32 counter operating as a divide-by 4 counter and the divide-by 16 counter as a divide-by 2 counter.

The counter 22 provides an output in binary-coded decimal representation to the input of a decoder 23 which translates the input signal into a three-bit code which appears on output leads $C_1$, $C_2$ and $C_3$. A source of voltage +V is connected through resistors $R_1$, $R_2$ and $R_3$ to the output leads $C_1$, $C_2$ and $C_3$, respectively. The output leads $C_2$ and $C_3$ are further connected to an input of AND gates 21 and 20, respectively, to apply the +V voltage to the respective AND gates when leads $C_2$ and $C_3$ are in the low output state, so that the forward-backward counter 22 may vary its count within a range of four counts. The decoder 23 provides four output signals each in a three-bit code corresponding to one of the four counts in the counter 22 and to each of the output signals is assigned the number of cylinders to be ignited. In the illustrated embodiment, the following signals are provided from the decoder 23 for the cylinders to be ignited:

| | | | | | |
|---|---|---|---|---|---|
| Output leads | $C_1$ | 0 | 1 | 1 | 1 |
| | $C_2$ | 1 | 1 | 0 | 1 |
| | $C_3$ | 1 | 1 | 1 | 0 |
| No. of ignited cylinders | | 6 | 5 | 4 | 3 |

During the time interval $t=t_0$ to $t=t_3$, the decoder 23 provides a three-bit code "011" in its output leads $C_1$, $C_2$ and $C_3$ which ignites all of the cylinders (6 in the illustrative embodiment) to provide full engine output power. At time $t=t_3$, the flip-flop 14 has been in the high Q output state which enables the AND gate 20 to provide a "1" output 101 therefrom when the divide-by 32 counter 18 generates an output 102. The pulse 101 from AND gate 20 activates the down count input of the forward-backward counter 23 to count down the stored binary count so that the decoder 23 output will shift to a code "111" which indicates that the number of cylinders to be fuel injected, or ignited is five.

The signals from the output leads $C_1$ to $C_3$ of decoder 23 are coupled to the injection pulse distributer 7 (FIG. 1B). The output lead $C_1$ is connected to a ring counter 30 to which is also applied injection pulses over lead 30*a*. The ring counter 30 is enabled by the high output signal on lead $C_1$ to distribute a "0" output pulse in sequence on one of its output leads 31 to 36 in response to each injection pulse. Various gate circuits are connected to the output leads 31 to 36 to pass injection pulses in two phases to the selected cylinders No. 1 to No. 6. During the time interval from the start of the engine to time $t=t_3$, the ring counter 30 is disabled by the low output on lead $C_1$ and the output leads 31 to 36 of ring counter 30 are all at high output level.

In the circuit of FIG. 1B, the output leads 31 and 34 are connected to input terminals of a NAND gate 40 whose output is connected to one input of a NAND gate 43 with its output being connected to one input of NAND gates 61, 62 whose outputs are connected to one input of NOR gates 71, 76. The outputs of NOR gates 71 and 76 are respectively connected to the injection unit of the cylinders No. 1 and No. 6. The output leads 32 and 35 are connected to input terminals of a NAND gate 41 whose output is connected to one input of a NAND gate 44 with its output being connected to one input of NAND gates 63, 64 whose outputs are connected to one input of NOR gates 73 and 74, respectively. The outputs of NOR gates 73, 74 are connected to the injection unit of the cylinders No. 3 and No. 4, respectively, through a drive circuit (not shown). Similarly, the output leads 33 and 36 are connected to input terminals of a NAND gate 42 whose output is connected to an input of a NAND gate 45 with its output being connected to one input of NAND gates 62 and 65 whose outputs are connected to one input of NOR gates 72 and 75, respectively. The outputs of NOR gates 72 and 75 are connected to the ignition unit of the cylinders No. 2 and No. 5, respectively, through a respective drive circuit (not shown).

The output leads 31, 32 and 33 are further connected to input terminals of a NAND gate 46 whose output is connected to an input of a NAND gate 48 with its output being connected to another input of NAND gates 61, 62 and 63. The output leads 34, 35 and 36 are further connected to input terminals of a NAND gate 47 whose output is connected to one input of a NAND gate 49 with its output connected to another input of NAND gates 64, 65 and 66. All the output leads 31 to 36 are still further connected to the other input of NAND gates 61 to 66 through OR gates 51 to 56, respectively.

The lead $C_2$ from the decoder 23 is connected through an inverter 57 to the other input of NAND gates 43, 44 and 45, and the lead $C_3$ is connected through an inverter 58 to the other input of NAND gates 48 and 49. The leads $C_2$ and $C_3$ are further connected to input terminals of a NAND gate 59 whose output is connected to the other input of OR gates 51 to 56. The NOR gates 71, 72 and 73 have their other inputs connected together to a source of negative going injection pulses which occur in phase 1 and the NOR gates 74, 75 and 76 have their other inputs connected together to a source of negative going injection pulses which occur in phase 2, so that the cylinders No. 1 to No. 3 are ignited at different timing from the cylinders No. 4 to No. 6.

In the 6-cylinder ignition mode, all the output leads 31 to 36 are at high level potential. Under this condition, NAND gate 40 provides a "0" output which switches the NAND gate 43 to the "1" output state and at the same time NAND gate 46 provides a "0" output which switches the NAND gate 48 to the "1" output state. Therefore, the output of NAND gate 61 goes low and the NOR gate 71 will pass the injection pulse to the fuel injection unit of the cylinder No. 1. Similarly, each of the other NAND gates 62 to 66 provides a low-level output to enable NOR gates 72 to 76 so that the cylinders No. 2 to No. 6 are fuel injected by the injection pulses passed through the enabled NOR gates.

During the time interval $t=t_3$ to $t=t_4$, the pulse 102 from the divide-by 32 counter 18 is passed through AND gate 20 to the forward-backward counter 22 to down count its content. This down count changes the decoder 23 output to "111". With the $C_1$ output lead being at "1", the ring counter 30 is enabled to commence distibution of a low-level output pulse. With the lead 31 being at a low potential and the other leads being at high potential, NAND gate 61 provides a high-level output to the NOR gate 71 to prevent the injection pulse from passing therethrough to the cylinder No. 1 ignition unit, while the other NAND gates 62 to 66 provide low-level outputs to corresponding NOR gates to allow the cylinders No. 2 to No. 6 to be ignited. At the next injection pulse on lead 30*a* of counter 30, the output lead 32 goes low while the other leads are at high output level, and as a result NAND gate 62 will be selected to inhibit the passage of injection pulse through the NOR gate 72 so that the cylinder No. 2 is inhibited while the other cylinders are ignited. Similarly, the cylinders No. 3 to No. 6 are inhibited one at a time for each successive injection pulse, and thus the engine is operated in a 5-cylinder ignition mode. This mode of engine operation terminates at time $t=t_4$ when the divide-by 32 counter 18 produces the next output pulse 103. Since the AND gate 20 is enabled by the high-level output from output lead $C_3$ and the Q output of flip-flop 14, the pulse 103 is passed through the AND gate 20. The forward-backward counter 22 is down counted to shift the output data from decoder 23 to "101". The lowering of the potential at the lead $C_2$ will turn the second input of NAND gates 43, 44 and 45 to the "1" state and a "1" is applied through respective one of OR gates 51 to 56 to the first input of NAND gates 61 to 66. Under these conditions, the first "0" output on lead 31 will place a "0" on the output of NAND gate 43 and as a result NAND gates 61 and 66 inhibit the NOR gates 71 and 76 so that cylinders No. 1 and No. 6 are inhibited. The second low output pulse on lead 32 will in turn place a "0" on the output of NAND gate 44 to permit NAND gates 63 and 64 to generate inhibit pulses to the NOR gates 73 and 74 to inhibit the cylinders No. 3 and No. 4 at the same time. On the third pulse on lead 33, NAND gate 45 will be activated to provide inhibit pulses from NAND gates 62 and 65 to the NOR gates 73 and 74 to inhibit the cylinders No. 2 and No. 5 simultaneously. This process will be repeated until time $t=t_5$ when the next pulse 104 from the divide-by 32 counter 18 occurs. The pulse 104 is passed through AND gate 20 to the counter 22 as long as the decoder 23 retains its previous code. The counter 22 is down counted so that the next code "110" appears at the decoder 23 output. With the lead $C_3$ being at "0", a "1" is placed on the second input of NAND gates 48 and 49. In the first half period of the ring counter the output of NAND gate 46 goes high as long as it receives the first, second and third pulses from leads 31 to 33 of ring counter 30 to generate a "0" output from NAND gate 48 and in the second half period of the ring counter the output of NAND gate 47 goes high as long as it receives the fourth, fifth and sixth pulses from leads 34 to 36 to generate a "0" output from NAND gate 49. Therefore, NAND gates 61 to 63 are turned to the high output state to inhibit the cylinders No. 1 to No. 3 during the first half period of the ring counter cycle, and NAND gates 64 to 66 are likewise turned to the high output state to inhibit the cylinders No. 4 to No. 6 during the second half period of the ring counter cycle. It will be understood from the foregoing that when the vehicle enters light load condition, the mode of operation changes from the six-cylinder ignition mode to the three-cylinder ignition mode by inhibiting one cylinder for each mode and during the steady state drive the engine is driven under the three-cylinder ignition mode.

At the end of the time interval $t=t_5$ to $t=t_6$ in FIG. 2B, the engine is accelerated with the consequent pressure depression in the intake manifold. The level detectors 4 and 5 generate low-level outputs and the Q output of flip-flop 14 goes low and its complementary Q output goes high. The AND gate 21 is enabled to pass an output pulse 105 from divide-by 16 counter 19 to the up-count terminal of the forward-backward counter 22. The output of decoder 23 changes to "101" to operate the engine in a four-cylinder ignition mode. The counter 22 is up counted by the next pulse 106 from the counter 19 to permit the engine to enter five-cylinder ignition mode at time $t=t_7$. The four-cylinder ignition period from $t=t_6$ to $t=t_7$ is controlled by the short interval pulses from divide-by 16 counter 19 so that the ignition mode is shifted at a faster rate to a larger number ignition mode when accelerated than is shifted to a lesser number ignition mode when the vehicle enters the cruising state, or light load condition. If the condition of larger pressure depression as indicated by broken lines 106 in FIG. 2B(*b*), the fifth-cylinder ignition mode is also controlled by the divide-by 16 counter 19 so that the mode will be shifted to six-cylinder ignition at a higher rate than said mode is shifted to four-cylinder ignition.

During the time interval $t=t_8$ to $t=t_9$, the pressure depression lies between the first and second pressure levels, and the high level detector 4 provides a high-level output to turn the Q output of flip-flop 16 to the "0" binary state. This disables the AND gate 17 to inhibit the passage of injection pulses to the counters 18 and 19. Therefore, the five-cylinder ignition mode exists as long as the pressure depression lies between the first and second detected levels.

As the engine is decelerated, the pressure depression decreases to fall below the lower detected level at time $t=t_9$ and the low level detector 5 provides a high-level output which turns the Q output of flip-flop 14 and the Q output of flip-flop 16 to the "1" output state. Instead of AND gate 21, AND gate 20 is enabled by the high Q output of flip-flop 14 to pass the output of counter 18 to the down-count input of forward-backward counter 22. Simultaneously, AND gate 17 is enabled to pass the injection pulses to the counters 18 and 19. Counter 22 is down-counted so that the ignition mode is changed to four-cylinder ignition at time $t=t_9$.

As the vehicle speed decreases below the specified limit at time $t=t_{10}$, the flip-flop 14 changes its Q output state to "1" so that AND gate 21 is enabled to pass an output signal 107 from counter 19 to the up-count input of counter 22 to shift the ignition mode to five-cylinder ignition at time $t=t_{11}$. Upon the occurrence of the next pulse 108 from counter 19, the engine operation mode is shifted to the full cylinder ignition at time $t=t_{12}$.

It is understood from the foregoing description that when light load is sensed by the low-level detector 5 the cylinders are successively inactivated one cylinder at a time from the full cylinder ignition to a three-cylinder ignition. The vehicle driver will operate the acceleration pedal in order that the loss of power due to the inactivation is compensated for by supplying additional fuel to the active cylinders and as a result the fuel will be combusted in the active cylinders at the maximum efficiency.

Since the inhibit or cut-off pulses are distributed evenly over the cylinders, possible vibration of the engine due to the partial cylinder inactivation is suppressed to a minimum level with a resultant prolongation of the usable life of the cylinders. Furthermore, the rapid increase in the number of activated cylinders when heavy load condition is encountered will prevent the engine from delivering insufficient output power during acceleration.

The foregoing description shows only a preferred embodiment of the present invention. Various modifications are apparent to those skilled in the art without departing from the scope of the present invention which is only limited by the appended claims. Therefore, the embodiment shown and described is only illustrative, not restrictive.

What is claimed is:

1. Apparatus for controlling the injection of fuel to the cylinders of an electronically fuel injected internal combustion engine mounted on a roadway vehicle having means for generating injection pulses to be applied to the injection unit of each cylinder, comprising:

means for sensing the magnitude of load exerted on said engine;

means for varying the number of active cylinders such that the number of cylinders to be fuel-injected for ignition decreases one at a time when the sensed engine load is below a first predetermined value, increases one at a time when the sensed engine load is above a second predetermined value greater than the first predetermined value and maintains constant when the sensed engine load is between the first and second values; and means for inhibiting the injection of fuel to one or more cylinders corresponding in number to said number of inactive cylinders.

2. Apparatus as claimed in claim 1, further comprising means for sensing the speed of the vehicle and means for allowing all of said cylinders to be fuel injected when the vehicle speed is below a predetermined speed level.

3. Apparatus as claimed in claim 1, wherein said means for varying the number of cylinders comprises:

means for generating a first signal when the sensed engine load is below the first predetermined value and a second signal when the sensed engine load is above the second predetermined value;

a forward-backward counter having up and down count modes ad responsive to the first signal to operate in the up count mode and responsive to the second signal to operate in the down count mode; and means for inhibiting the firstand second signals when the sensed engine load is between the first and second predetermined values so that the stored count is maintained constant.

4. Apparatus as claimed in claim 3, wherein said signal generating means comprises a first counter for counting the injection pulses to generate a first count output at a first predetermined number of the counted injection pulses, a second counter for counting the injection pulses to generate a second count output at a second predetermined number of the counted injection pulses smaller than the first predetermined number, a first gate for passing the first count output to said forward-backward counter to operate the same in one of the up- and down-count modes when the engine load is below said first predetermined value and a second gate for passing the second count output to said forward-backward counter to operate the same in the other mode when the engine load is above said second predetermined value.

5. Apparatus as claimed in claim 4, wherein the output from said forward-backward counter is connected to the first and second gates such that the forward-backward counter changes its stored count within a predetermined range of counts.

6. Apparatus as claimed in claim 1, wherein said injection inhibiting means for sequentially shifting one or more of the cylinders to be inhibited in response to the injection pulse.

7. Apparatus as claimed in claim 6, wherein said injection inhibiting means comprises:

a ring counter for recyclically generating a pulse in response to each injection pulse in succession on one of a plurality of terminals equal in number to said cylinders;

a plurality of gates operatively connected to the terminals of the ring counter; and a logic circuit connected to said terminals to generate control pulses corresponding to the stored count of the forward-backward counter for controlling the gates, said control pulses being sequentially applied to said gates in step with the occurrence of each injection pulse to pass the injection pulses through the controlled gates to the fuel injection injection unit of the cylinders.

8. A method for controlling the cylinders of an electronically fuel injected internal combustion engine mounted on a roadway vehicle by successively inactivating the cylinders in response to the engine load, comprising the steps of:

sensing the magnitude of the engine load;

operating the cylinders in one of different modes in response to the sensed engine load such that there is a different number of active and inactive cylinders for each mode;

successively shifting the mode from one to another when the second engine load is below a predetermined level such that there is a smaller number of active cylinders than the previous mode of the amount of one active cylinder;

successively shifting the mode from one to another when the sensed engine load is above a second predetermined level greater than the first predetermined level such that there is a greater number of active cylinders than the previous mode by the amount of one active cylinder; and maintaining the mode when the sensed engine load is between the first and second predetermined levels.

9. A method as claimed in claim 8, wherein the step of operating the cylinders comprises generating activating and inactivating control signals for the cyliners, distributing said control signals to the fuel injection units of said cylinders, and sequentially shifting said control signals from one cylinder to another in step with the combustion cycle of each cylinder.

10. A method as claimed in claim 8, wherein the mode is shifted to the next at a higher rate when the sensed engine load is above the second predetermined level than when the sensed engine load is below the first predetermined level.

11. A method as claimed in claim 8, further comprising sensing the speed of the vehicle and operating the engine such that all of said cylinders are fuel injected for ignition when the sensed vehicle speed is below a predetermined speed level.

* * * * *